US005686383A

United States Patent [19]

Long et al.

[11] Patent Number: 5,686,383

[45] Date of Patent: Nov. 11, 1997

[54] METHOD OF MAKING A COLOR FILTER ARRAY BY COLORANT TRANSFER AND LAMINATION

[75] Inventors: Michael Edgar Long, Bloomfield; Michael Louis Boroson, Rochester, both of N.Y.

[73] Assignee: Eastman Kodak Company, Rochester, N.Y.

[21] Appl. No.: 644,760

[22] Filed: May 10, 1996

[51] Int. Cl.[6] ..... B41M 5/035; B41M 5/38

[52] U.S. Cl. ..... 503/227; 359/62; 359/67; 359/68; 359/885; 359/892; 428/195; 428/212; 428/913; 428/914; 430/4; 430/321; 430/322; 430/324

[58] Field of Search ..... 8/471; 359/885, 359/62, 67, 68, 892; 428/195, 913, 914, 212; 430/321, 4, 322, 324; 503/227

[56] References Cited

U.S. PATENT DOCUMENTS 4,081,277 3/1978 Brault et al. ..... 96/38.2

4,743,463 5/1988 Ronn et al. ..... 427/53.1

4,923,860 5/1990 Simons ..... 503/227

4,965,242 10/1990 DeBoer et al. ..... 503/227

5,229,232 7/1993 Longobardi et al. ..... 430/7

*Primary Examiner*—Bruce H. Hess

*Attorney, Agent, or Firm*—Raymond L. Owens

[57] ABSTRACT

A method for preparing a color filter array element is disclosed which includes coating an image receiving layer on one surface of a thin support, with the thin support being rigid in the horizontal plane. Thereafter, a colored pattern of pixel cells is transferred from a colorant donor sheet onto the image receiving layer. The method further includes laminating to a surface of a rigid, transparent support either the coated surface of the thin, rigid support carrying the colored pattern of pixel cells or the other surface of the thin, rigid support, to thereby form the color filter array element.

15 Claims, 1 Drawing Sheet

METHOD OF MAKING A COLOR FILTER ARRAY BY COLORANT TRANSFER AND LAMINATION

CROSS-REFERENCE TO RELATED APPLICATIONS

Reference is made to and priority claimed from U.S. Provisional application Ser. No. 60/002,658, field 22 Aug. 1995, entitled METHOD OF MAKING A COLOR FILTER ARRAY BY COLORANT TRANSFER AND LAMINATION.

Reference is made to commonly assigned U.S. application Ser. No. 08/428,469 filed Apr. 26, 1995, entitled "Color Filter Arrays By Stencil Printing" by Charles DeBoer et al and commonly assigned U.S. application Ser. No. 08/638,457 filed concurrently herewith, entitled "Method of Making A Color Filter Array By Lamination Transfer" by Charles DeBoer et al.

FIELD OF THE INVENTION

This invention relates to a method of forming a color filter array element by colorant transfer and lamination.

BACKGROUND OF THE INVENTION

Color filter array elements can be used in various display devices such as a liquid crystal display device. One commercially available type of color filter array element that has been used in liquid crystal display devices for color display capability is a transparent support having a gelatin layer thereon which contains dyes having the additive primary colors red, green and blue in a mosaic pattern obtained by a photolithographic technique. To prepare such a color filter array element a gelatin layer is sensitized, exposed to a mask for one of the colors of the mosaic pattern, developed to harden the gelatin in the exposed areas, and washed to remove the unexposed (uncrosslinked) gelatin, thus producing a pattern of gelatin which is then dyed with dye of the desired color. The element is then recoated and the above steps are repeated to obtain the other two colors. Misalignment or improper deposition of color materials may occur during any of these operations. This method therefore contains labor-intensive steps, requires careful alignment, is time-consuming and very costly. Further details of this process are disclosed in U.S. Pat. No. 4,081,277.

Color liquid crystal display devices generally include two spaced glass panels which define a sealed cavity that is filled with a liquid crystal material. For actively-driven devices, a transparent electrode is formed on one of the glass panels, which electrode may be patterned or not, while individually addressable electrodes are formed on the other of the glass panels. Each of the individual electrodes has a surface area corresponding to the area of one picture element, or pixel. If the device is to have color capability, each pixel must be aligned with a color area, e.g. red, green, or, blue, of a color filter array element. Depending on the image to be displayed, one or more of the pixel electrodes is energized during display operation to allow full light, no light, or partial light to be transmitted through the color filter area associated with that pixel. The image perceived by a user is a blending of colors formed by the transmission of light through adjacent color filter areas.

In liquid crystal display devices, the transparent electrode typically used is indium tin oxide (ITO). ITO must be thermally cured, preferably at temperatures in excess of 200 degrees C. up to 260 degrees C. to obtain the desired conductivity. However, the materials commonly used in color filter array elements degrade at temperatures higher than nominally 180 degrees C. Therefore, thermal curing is done at lower temperatures and/or shorter times, causing a decrease in the conductivity of the ITO.

In the display of high quality images, the quality of the color filter array element is quite important. Unfortunately, the cost of such color filter array elements is quite high and is one of the most costly components of the liquid crystal display device. One promising method to reduce the cost of color filter array manufacture while still maintaining the required quality is by use of a thermal dye transfer method as discussed in U.S. Pat. Nos. 4,923,860; 4,965,242; and 5,229,232, the disclosures of which are herein incorporated by reference. In the method described therein, the color filter array element is formed in a relatively few steps by thermally transferring dye to a receiver coated support from a dye donor by use of a mask and a high intensity flash system. However, the high intensity flash will produce larger size pixels which decreases resolution. Furthermore, the use of a mask limits the flexibility in the design of the color pattern, and is labor-intensive, time-consuming and costly.

Previous methods of forming a color filter array element utilize a laser to transfer dye from a dye donor to a receiver coated support to eliminate the need for a mask and improve resolution. However, such methods, as disclosed in U.S. Pat. No. 4,743,463, require the use of an "'X–Y' coordinate table" because of the rigidity of the glass, which is very time-consuming.

In the display of high quality images, it is also important that the pixel cells be highly uniform, both in size and in color. A particularly objectionable defect in liquid crystal displays is a pixel drop out, i.e., a pixel cell that is always light or always dark. The human eye is drawn to such a cell in an image, in a compulsive and annoying way. The source of such drop-out pixels is often an electrical short through the liquid crystal material caused by a particle of dust trapped during the steps of coating, patterning, dyeing and washing the pixels of the color filter array element. Although the color filter array element produced by the thermal dye transfer method, as disclosed, for example, in U.S. Pat. No. 4,965,242, provides an effective color filter array element, dust particles can get trapped on the surfaces of the color filter array elements during manufacture which can cause electrical shorts or pixel drop-outs. In addition, the color filter array elements are susceptible to abrasions and protrusions, which can also cause electrical shorts or pixel drop-outs. To avoid these dust particles, most or all of the manufacture steps are typically carried out in highly filtered "clean room" environments. The extra burden of operation in a clean room is labor-intensive, time-consuming and very costly.

The display of high quality images also requires proper alignment of the color filter array element on integrated electronics that are associated with the liquid crystal display device. Prior art color filter array elements, such as those made in accordance with the method described in U.S. Pat. No. 4,965,242 have been formed with material having different thermal expansion properties than the integrated electronics. At different temperature ranges, the material of the color filter array element exhibits different thermal expansion characteristics, causing misalignment of the color filter array element and the integrated electronics, which can result in a poor quality displayed image.

SUMMARY OF THE INVENTION

It is an object of this invention to provide a method of producing color filter array elements that maintain substantially the same dimensions under various temperature ranges.

Another object of this invention is to provide color filter array elements having increased resolution.

These objects are achieved in a method for preparing a color filter array element, comprising the steps of:

a) forming a colored pattern of pixel cells on one surface of a thin support, with the thin support being rigid in the horizontal plane; and b) laminating to a surface of a rigid, transparent support having substantially the same thermal expansion characteristics as the thin, rigid support, either the surface of the thin, rigid support carrying the colored pattern of pixel cells or the other surface of the thin, rigid support, to thereby form the color filter array element.

ADVANTAGES

A color filter array element according to this invention provides for a color filter array element which maintains substantially the same dimensions under various temperature ranges.

A color filter array element according to this invention provides for thermal curing of the transparent electrode at preferred elevated temperatures and extended curing times.

A color filter array element according to this invention provides for reduced manufacturing costs, increased design flexibility and reduced preparation time by controlling the color filter pattern by software and eliminating the need for a dye donor mask. A color filter array element according to this invention provides for decreased production time by utilizing a rotating drum system.

A color filter array element according to this invention provides a color filter array element having a clean, flat surface, without dust specks or protrusions that can cause electrical shorts and pixel drop-outs.

A color filter array element according to this invention further provides a color filter array element having increased resolution.

A color filter array element according to this invention does not need to be produced in a clean room environment.

DETAILED DESCRIPTION OF THE PREFERRED EMBODIMENTS

Figure 1:
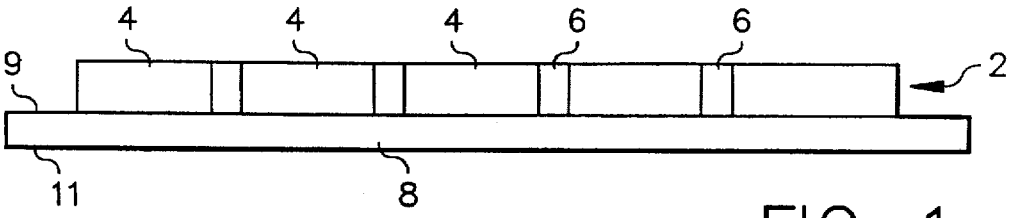
FIG. 1 is a schematic sectional view of a color filter array element formed on a thin, rigid support in accordance with this invention.

Where parts or elements correspond to FIG. 1, the same numerals will be used. Turning to FIG. 1, a schematic diagram of a color filter array element 2 formed on a thin, rigid support 8 in accordance with this invention is shown. The color filter array element 2 includes red (R), green (G), and blue (B) color cells or pixels cells 4 corresponding to pixels. The pixel cells 4 are separated from each other by an opaque area, e.g., black grid lines 6, to provide improved color reproduction and to reduce flare in the displayed image.

In accordance with the present invention, the color filter array element 2, as shown in FIG. 1, is formed by creating a colored pattern of pixel cells 4 on the thin, rigid support 8. To create the colored pattern of pixel cells 4, surface 9 of the thin, rigid support 8 is overcoated with an image-receiving layer having an image-receiving surface. By the use of the term "thin" is meant a support 8 with a thickness in the range of 10 microns to 250 microns. In accordance with the present invention, the image-receiving layer can include, for example, those polymers as described in U.S. Pat. Nos. 4,695,286; 4,740,797; 4,775,657; and 4,962,081, the disclosures of which are herein incorporated by reference. Preferably, the image-receiving layer includes polycarbonates having a glass transition temperature greater than about 200 degrees C. Alternatively, polycarbonates derived from a methylene substituted bisphenol A such as 4, 4'-(hexahydro-4,7-methanoindan-5-ylidene)-bisphenol are employed. Good results have been obtained at a coverage of from about 0.25 to about 5 mg/m$^2$.

After the image-receiving layer is formed on surface 9 of the thin, rigid support 8, a repeating pattern of colorants corresponding to the desired colored pattern on pixel cells 4 is transferred to the image-receiving layer. The colorants can include pigments, dyes, or dichroic layers which are colored by virtue of the interference cancellation of certain wavelengths of light. Preferably, the colorants are dyes, which are more fully described below. Black grid lines 6 are then laid down to thereby form the color filter array element 2 of this invention.

After the color filter array element 2 has been formed on surface 9 of the thin, rigid support 8, the color filter array element 2 is laminated to a rigid, transparent support 10 having substantially the same thermal expansion characteristics as the thin, rigid support 8. The color filter array element 2 is laminated to the rigid, transparent support 10 by heat and pressure, or by an optional glue layer 12. If the glue layer 12 is used, it is important that no air bubbles remain in the glue layer 12 to distort the image.

Both the thin, rigid support 8 and the rigid, transparent support 10 in accordance with this invention are preferably glass low in ion content, such as borosilicate glass, and quartz. Preferably, borosilicate glass is employed.

Figure 2:
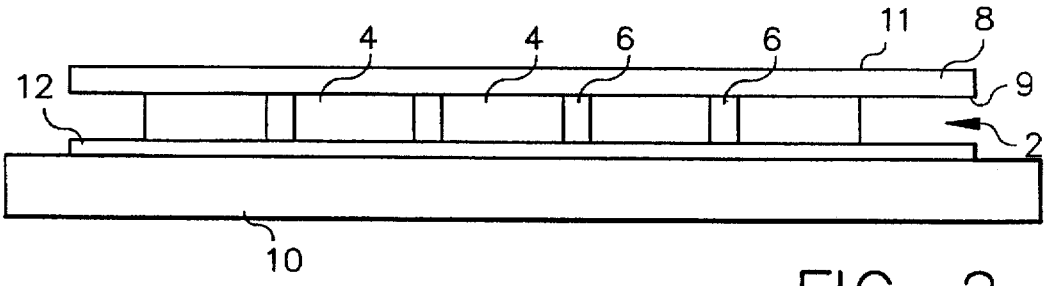
FIG. 2 is a schematic sectional view of a color filter array element formed on a thin, rigid support, and laminated to a rigid, transparent support in accordance with this invention.

The embodiment of this invention includes two configurations. In one configuration, as shown in FIG. 2, the color filter array element 2 formed on surface 9 of the thin, rigid support 8 is placed in contact with the rigid, transparent support 10, and the glue layer 12 is used such that the fluid epoxy glue which has been centrifuged to remove air bubbles is wicked into the air gap between the rigid, transparent support 10 and the color filter array element 2. The force of the capillary action causes the fluid glue to fill the entire space between the rigid, transparent support 10 and the color filter array element 2, driving out the air as the glue moves across the space. The glue layer 12 can be placed originally on either the color filter array element 2 or the rigid, transparent support 10 prior to lamination. The assembly is then heated to cure the epoxy glue. In this configuration, as shown in FIG. 2, the color filter array element 2 is laminated face-to-face on the rigid, transparent support 10. Therefore, preparation of the color filter array element 2 can be performed outside of a clean room environment.

Figure 3:
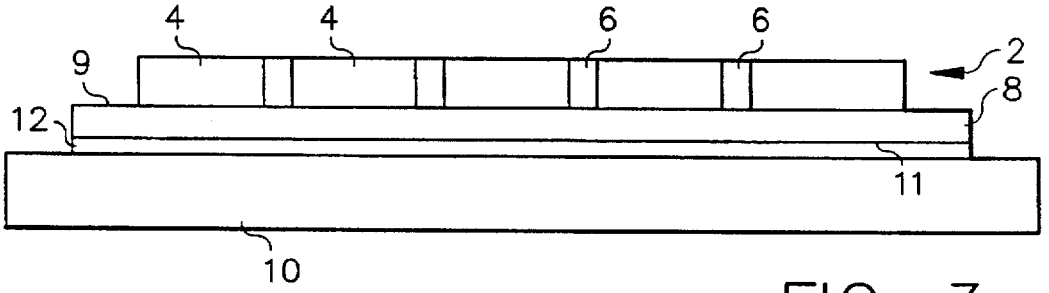
FIG. 3 is a schematic sectional view of a color filter array element formed on a thin, rigid support and laminated to a rigid, transparent support in accordance with this invention.

Referring now to FIG. 3, another configuration of this invention is shown wherein surface 11 of the thin, rigid support 8 that is opposite surface 9 with the color filter array element 2 formed thereon is placed in contact with the rigid, transparent support 10. The color filter array element 2 is laminated to the rigid, transparent support 10 by the glue layer 12 such that the fluid epoxy glue which has been centrifuged to remove air bubbles is wicked into the air gap between the rigid, transparent support 10 and the thin, rigid support 8 in the same manner as described above for the first configuration of this invention.

It is well known in the art, as described in U.S. Pat. No. 5,218,380, the disclosure of which is herein incorporated by reference, that the colorant from a colorant donor sheet can be thermally transferred to the image-receiving layer on the thin, rigid support 8 by a thermal printer assembly not shown. The assembly includes a thermal print head and a rotating platen such as a drum. The thermal print head includes a laser which is used to illuminate the colorant donor sheet. The image-receiving layer on the thin, rigid support 8 and the colorant donor sheet bear against one another, the rotating drum and the thermal print head.

In the preferred embodiment of this invention, colorants are transferred to the image-receiving layer on the thin, rigid support 8 by a laser. The colorant donor sheet includes a support having thereon a colorant layer and an absorbing material for the wavelength of the laser. While the drum is rotated, the laser illuminates the colorant donor sheet. The absorption of the laser energy causes heat to be generated which causes the colorants to sublime and transfer to the image-receiving layer. In accordance with this invention, the thin, rigid support 8 must be flexible enough in the vertical plane to wrap around the drum to print with the laser, but must be rigid enough in the horizontal plane to have similar thermal expansion characteristics to the integrated electronics.

Any material that absorbs the laser energy described above can be used as the absorbing material, for example, carbon black or non-volatile infrared-absorbing dyes or pigments which are well known to those skilled in the art. Preferably, cyanine infrared absorbing dyes are employed, as described in U.S. Pat. No. 4,973,572, the disclosure of which is herein incorporated by reference.

The intensity of the radiation should be high enough and the duration of the illumination should be short enough that there is no appreciable heating of the assembly with concomitant significant dimensional change in the colored pattern of pixel cells 4. Preferably, the duration of illumination by the laser is from 1 nanosecond to 25 milliseconds. The preferred intensity of radiation is from 10 Watts per sqare micrometer to $10^{-7}$ Watts per square micrometer.

Various methods other than laser light can be used to transfer the colorants from the colorant donor sheet to the image-receiving layer on the thin, rigid support 8 to form the color filter array element 2 of this invention. For example, a high intensity light flash from a xenon filled flash lamp can be used with a colorant donor sheet containing an energy absorbing material. The absorption of the high intensity light causes the colorant to transfer from the colorant donor sheet to the image-receiving layer. This method is more fully described in U.S. Pat. No. 4,923,860, the disclosure of which is herein incorporated by reference.

The colorants can also be transferred to the image-receiving surface of the image-receiving layer, for example, by ink jet printing, by heating a colorant donor sheet by a resistive head, or by electrophotography. The electrophotography method is more fully disclosed in U.S. Pat. No. 4,686,163, the disclosure of which is herein incorporated by reference.

In an embodiment of this invention, the color filter array element 2 includes a mosaic pattern having a repeating set of red, green, and blue additive primaries, i.e., red, green, and blue pixel cells 4. The mosaic pattern is preferably used for photographic images. The pixel cells 4 are separated from each other by the black grid lines 6. The mosaic pattern of colorant to form the color filter array element 2 includes uniform, linear repeating areas (approximately 100 microns) that can be either square or rectangular, with one color diagonal displacement as follows:

```
R G B R G B
B R G B R G
G B R G B R
```

In another embodiment of this invention, the color filter array element 2 includes a pattern of stripes which include a repeating set of red, green, and blue additive primaries, i.e., red, green, and blue pixel cells 4. The pattern of repeating stripes is preferably used for computer monitors. The pixel cells 4 are separated from each other by black grid lines 6. The repeating stripes of colorant to form the color filter array element 2 include uniform, linear repeating areas (approximately 100 microns) that can be either square or rectangular, with no color displacement as follows:

```
R G B R G B
R G B R G B
R G B R G B
```

In both the mosaic set and the set of stripes, the size of the set depends on the viewing distance, and is selected so that individual pixels are not visible at the viewing distance. In general, the individual pixels of the mosaic set are from about 50 to about 600 microns and do not have to be of the same size.

The colorants that are used to form the color filter array element 2 in accordance with the present invention can include any dye or mixture of dyes provided they are transferable to the image-receiving layer on the thin, rigid support 8 by the action of intense light. Especially good results have been obtained with sublimable dyes. Examples of sublimable dyes include anthraquinone dyes, e.g., Sumikalon Violet RS® (Sumito Chemical Co., Ltd.); Dianix Fast Violet 3R-FS® (Mitsubishi Chemical Industries, Ltd.); and Kayalon Polyol Brilliant Blue N-BGM®; Kayalon Polyol Dark Blue 2BM®; and KST Black KR® (Nippon Kayaku Co., Ltd.); Sumickaron Diazo Black 5G® (Mitsui Toatsu Chemicals, Inc.); direct dyes such as Direct Dark Green B® (Mitsubishi Chemical Industries, Ltd.); and Direct Brown M® and Direct Fast Black D® (Nippon Kayaku Co., Ltd.); acid dyes such as Kayanol Milling Cyanine 5R® (Nippon Kayaku Co., Ltd.); basic dyes such as Sumicacryl Blue 6G® (Sumitomo Chemical Co., Ltd.); and Aizen Malachite Green® (Hodogaya Chemical Co., Ltd.); or any of the dyes disclosed in U.S. Pat. Nos. 4,541,830; 4,698,651; 4,695,287; 4,701,439; 4,757,046; 4,743,582; 4,769,360; and 4,753,922, the disclosure of which are herein incorporated by reference.

Suitable dyes are further illustrated by the following structural formulas:

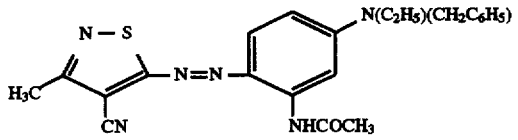

(magenta)

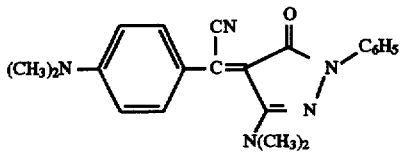

(magenta)

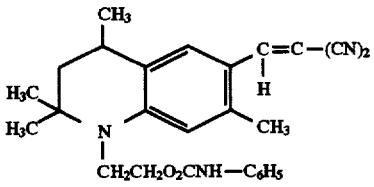

(yellow)

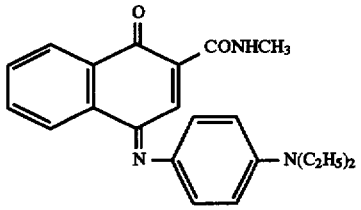

(cyan)

The above subtractive dyes can be employed in various combinations to obtain the desired red, blue, and green additive primary colors, as disclosed in U.S. Pat. Nos. 4,957,898; 4,975,410; and 4,988,665, the disclosures of which are herein incorporated by reference. The dyes can be mixed within the dye layer or transferred sequentially if coated in separate dye layers and can be used at a coverage of from about 0.05 to about 1 g/m2.

The color filter array elements prepared in accordance with this invention can be used in image sensors or in various electro-optical devices such as electroscopic light valves or liquid crystal display devices. Such liquid crystal display devices are described, for example, in U.K. Patents 2,154,355; 2,130,781; 2,162,674; and 2,161,971.

Figure 4:
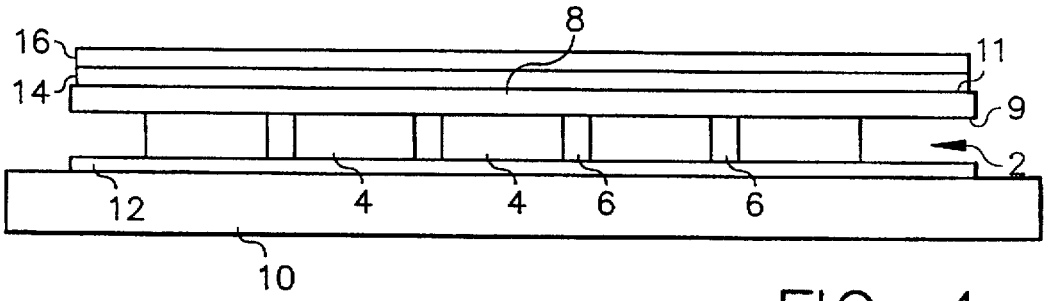
FIG. 4 is a schematic sectional view of the color filter array element of FIG. 2 for use in a liquid crystal display device, overcoated with a transparent conducting layer and a polymeric alignment layer

Referring to FIG. 4, a color filter array element 2 for use in liquid crystal display devices is shown, wherein the color filter array element 2 is laminated face-to-face to the rigid, transparent support 10. Prior to the formation of the color filter array element 2, surface 11 of the thin, rigid support 8 that is opposite surface 9 where the color filter array element 2 will be formed thereon is first coated with a transparent conducting layer 14. The transparent conducting layer 14 is thermally cured at the preferred temperature in excess of 200 degrees C. up to 260 degrees C. without degrading the color filter array element 2. The color filter array element 2 is then formed on the thin, rigid support 8 in accordance with this invention, which is thereafter laminated face-to-face to the rigid, transparent support 10. Thereafter, surface 11 of the thin, rigid support 8 is coated with the polymeric alignment layer 16.

The transparent conducting layer 14 is conventional in the liquid crystal art. Materials for the transparent conducting layer 14 include indium tin oxide, indium oxide, tin oxide, and cadmium stannate. The polymeric alignment layer 16 can be any of the materials commonly used in the liquid crystal art, including polyimides, polyvinyl alcohol, and methyl cellulose.

Figure 5:
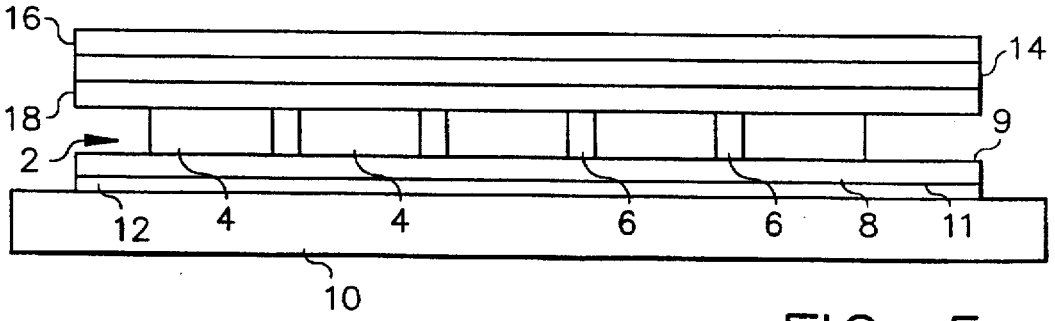
FIG. 5 is a schematic sectional view of the color filter array element of FIG. 3 for use in a liquid crystal display device, overcoated with a polymeric protective layer, a transparent conducting layer, and a polymeric alignment layer.

Referring now to FIG. 5, a color filter array element 2 for use in liquid crystal display devices is shown, wherein surface 11 of the thin, rigid support 8 that is opposite surface 9 with the color filter array 2 formed thereon is placed in contact with the rigid, transparent support 10. The color filter array element 2 is first coated with a polymeric protective layer 18, which is conventional in the liquid crystal art. Therafter, the color filter array element 2 is coated with the transparent conducting layer 14, followed by the polymeric alignment layer 16. The color filter array element 2 can be coated with the polymeric protective layer 18, the transparent conducting layer 14, and the polymeric alignment layer 16 either before or after the color filter array element 2 is laminated to the rigid, transparent support 10.

An example of a color filter array element prepared in accordance with this invention is described below.

EXAMPLE

A 4 inch square of thin, rigid glass (Corning 0211 Glass), 0.005 inches thick, was spin coated at 2000 rpm with a 10% solution of 4,4'-(hexahydro-4,7-methanoindan-5-ylidene) bisphenol polycarbonate in anisole and allowed to dry while spinning. The thin, rigid glass support was then wrapped around a 527 mm circumference drum, and held against the drum with tape. A colorant donor sheet was taped over the thin, rigid glass support, the colorant donor sheet consisting of a 35 micron thick film of polyethyleneterephthalate overcoated with a mixture consisting of 0.22 g/m2 Yellow dye A of U.S. Pat. No. 4,957,898, incorporated herein by reference; 0.26 g/m2 Magenta dye I of U.S. Pat. No. 4,947,898, incorporated herein by reference; 0.25 g/m2 Raven 1255® carbon, 0.20 g/m2 celluose acetate propionate (2.5% acetyl, 46% propionyl); and 0.008 g/m2 Fluorad FC-431® fluorosurfactant (a product of the 3M Corporation). The drum was rotated at 200 rpm and a 200 mW diode laser (830 nm wavelength) was focused onto the colorant donor sheet. The current to the laser beam was modulated in accordance with the desired pattern of color pixels. The dye image was then fused into the polycarbonate layer by placing the thin, rigid glass support in a container saturated with anisole vapor for 5 minutes. The dye image on the thin, rigid glass support was then laminated with application of uniform pressure to a 5 inch square piece of borosilicate glass (Corning 7059F), 0.043 inches thick, uniformluy spread by squeegee with 5 Minute Epoxy (Devcon Corporation), to thereby form a color filter array element.

The invention has been described in detail with particular reference to certain preferred embodiments thereof, but it will be understood that variations and modifications can be effected within the spirit and scope of the invention.

PARTS LIST 2 color filter array element
4 pixel cells
6 black grid lines
8 thin, rigid support
9 surface
10 rigid, transparent support 11 surface
12 glue layer
14 transparent conducting layer
16 polymeric alignment layer
18 polymeric protective layer

What is claimed is:

1. A method of making a color filter array element by colorant transfer, comprising the steps of:

a) forming an image receiving surface on one surface of a thin support, with the thin support being rigid in the horizontal plane;

b) transferring colorant to form a colored pattern of pixel cells in or on the image receiving surface; and c) laminating to a surface of a rigid, transparent support having substantially the same thermal expansion characteristics as the thin, rigid support, either the coated surface of the thin, rigid support carrying the colored pattern of pixel cells or the other surface of the thin, rigid support, to thereby form the color filter array element.

2. A method of making a color filter array element by colorant transfer, comprising the steps of:

a) coating an image receiving layer on one surface of a thin support, with the thin support being rigid in the horizontal plane;

b) thermally transferring from a colorant donor sheet a colored pattern of pixel cells in or on the image receiving layer on the thin, rigid support; and c) laminating to a surface of a rigid, transparent support having substantially the same thermal expansion characteristics as the thin, rigid support, either the coated surface of the thin, rigid support carrying the colored pattern of pixel cells or the other surface of the thin, rigid support, to thereby form the color filter array element.

3. The method in accordance with claim 2 wherein the colored pattern of pixel cells is thermally transferred to the image receiving layer by illumination by laser light.

4. The method in accordance with claim 2 wherein the colored pattern of pixel cells is thermally transferred to the image receiving layer by exposure of the colorant donor sheet to high intensity light.

5. The method in accordance with claim 4 wherein the colorant donor sheet is exposed to a high intensity xenon flash.

6. The method according to claim 2 wherein the thin, rigid support is glass.

7. The method according to claim 6 wherein the thin, rigid support is formed from borosilicate.

8. The method according to claim 6 wherein the thin, rigid support is formed from quartz.

9. The method according to claim 2 wherein the colorant donor sheet includes a polymeric dye.

10. The method according to claim 2 wherein the colorant donor sheet includes a support film overcoated with a mixture of color dye, polymeric binder, and light absorber.

11. The method according to claim 10 wherein the light absorber includes carbon.

12. The method according to claim 2 wherein the laminating step uses an epoxy glue.

13. A method of making a color filter array element by colorant transfer, comprising the steps of:

a) coating an image receiving layer on one surface of a thin support, with the thin support being rigid in the horizontal plane;

b) thermally transferring from a colorant donor sheet a colored pattern of pixel cells in or on the image receiving layer on the thin, rigid support; and c) laminating to a surface of a rigid transparent support having substantially the same thermal expansion characteristics as the thin, rigid support, the coated surface of the thin, rigid support carrying the colored pattern of pixel cells, to thereby form the color filter array element.

14. The method according to claim 13 wherein the surface of the thin, rigid support overcoated with the image receiving layer is first overcoated with a thin, transparent conducting layer.

15. A method of making a color filter array element by colorant transfer, comprising the steps of:

a) coating an image receiving layer on one surface of a thin support, with the thin support being rigid in the horizontal plane;

b) thermally transferring from a colorant donor sheet a colored pattern of pixel cells in or on the image receiving layer on the thin, rigid support; and c) laminating to a surface of a rigid transparent support having substantially the same thermal expansion characteristics as the thin, rigid support, the other surface of the thin, rigid support, to thereby form the color filter array element.

* * * * *